US006315236B1

(12) United States Patent
Oberstrass et al.

(10) Patent No.: US 6,315,236 B1
(45) Date of Patent: Nov. 13, 2001

(54) APPARATUS AND METHOD FOR GUIDING AND CUTTING AN ADVANCING YARN DURING A PACKAGE DOFF

(75) Inventors: Detlev Oberstrass, Velbert; Michael Pyra, Brüggen; Peter Dammann, Remscheid, all of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/557,477

(22) Filed: Apr. 24, 2000

(30) Foreign Application Priority Data

Apr. 23, 1999 (DE) ..... 199 18 524

(51) Int. Cl.[7] ..... B65H 54/22; B65H 67/04

(52) U.S. Cl. ..... 242/473.8; 242/475.7; 242/481.4; 242/486.1

(58) Field of Search ..... 242/473.8, 473.7, 242/475.7, 476.5, 481.4, 486.1

(56) References Cited

U.S. PATENT DOCUMENTS

| | | | | |
|---|---|---|---|---|
| 3,830,439 | * | 8/1974 | Porter | 242/486.1 |
| 4,081,149 | * | 3/1978 | Miller | 242/476.4 |
| 4,101,086 | * | 7/1978 | Thomas, Jr. | 242/476.5 |
| 4,948,057 | | 8/1990 | Greis . | |
| 5,029,762 | * | 7/1991 | Behrens et al. | 242/476.5 |
| 5,465,916 | * | 11/1995 | König | 242/486.1 X |
| 5,511,734 | * | 4/1996 | Enger et al. | 242/476.5 X |
| 5,681,000 | * | 10/1997 | Göbbels et al. | 242/475.7 |
| 6,045,081 | * | 4/2000 | Oberstrass et al. | 242/473.8 |
| 6,189,826 | * | 2/2001 | Oberstrass | 242/473.8 |

FOREIGN PATENT DOCUMENTS 0 311 827 B1 4/1989 (EP) .

* cited by examiner

*Primary Examiner*—Michael R. Mansen
(74) *Attorney, Agent, or Firm*—Alston & Bird LLP

(57) ABSTRACT

An apparatus and a method for guiding and cutting a continuously advancing yarn during a package doff in a takeup device. In this connection, a movable yarn guide guides the yarn substantially parallel to a package or a winding tube, which is driven by a drive roll. The yarn guide is followed by a suction device, which consists of a pneumatic suction inlet end and a cutting device. The suction device cooperates with a transfer device for purposes of cutting the yarn during the package doff and receiving the loose end of the advancing yarn. To protect the yarn during the package doff, the yarn guide extends in the yarn path upstream of the driven tube, and the suction device downstream thereof. For catching the yarn and winding initial layers thereof on a new winding tube that is driven by the drive roll, the yarn is guided in a yarn guide groove provided on the circumference of the drive roll or on the circumference of the new winding tube so that the yarn is protected within the contact zone between the accelerating winding tube and the drive roll.

17 Claims, 3 Drawing Sheets

APPARATUS AND METHOD FOR GUIDING AND CUTTING AN ADVANCING YARN DURING A PACKAGE DOFF

BACKGROUND OF THE INVENTION

The present invention relates to an apparatus for guiding and cutting a continuously advancing yarn, and winding initial layers thereof during a package doff in a takeup device, as well as to a method of guiding and cutting a continuously advancing yarn. An apparatus and method of this general type are known from EP 0 311 827.

In textile machines, for example, a crimped yarn is continuously wound to a package. After the package is completely wound, it is doffed. To this end, it is necessary that the yarn be first cut, so that the full package with the loose yarn end can be replaced with a new empty tube. During the doff, the yarn end of the continuously advancing yarn is received and removed by a pneumatic suction device. After completion of the package doff, the yarn is caught by means of a catching device and wound on the new tube.

In the apparatus and method disclosed in EP 0 311 827, the yarn is guided by a movable yarn guide outside of the winding range to a suction device laterally adjacent the winding range, after the package is fully wound. After completion of the package doff, and once the new tube is ready for catching, the yarn guide is pivoted back to the winding range. To transfer or catch the yarn, a transfer device deflects the yarn between the suction device and the yarn guide and offers it to the yarn catching device for engagement.

The known apparatus and method have the disadvantage that at the end of a winding cycle , the loose yarn end lies against the fully wound package in an undefined manner, which complicates locating the loose yarn end in particular in the further processing.

Furthermore, the deflection of the yarn by the transfer device for engaging the yarn leads to considerable looping, which results in major tension fluctuations in the yarn in proportion with the winding tension. Such tension fluctuations may lead to lapping on upstream feed elements.

It is accordingly an object of the invention to provide an apparatus and method of the initially described kind, so as to ensure that during a package doff, when the yarn is guided and caught, and when first layers thereof are wound, the yarn is guided as gently as possible with little deflection.

A further object of the invention is to ensure after cutting the yarn that the loose yarn end lies against a tie-off bead of the full package, and that the advancing yarn is threaded on a new tube without substantial slack.

SUMMARY OF THE INVENTION

The invention is characterized in that the yarn guide and the suction device are arranged within the winding range at the beginning of the package doff. In this connection, the winding range is the range on the tube, which is covered by the traversed yarn. Thus, the yarn can be cut with relatively little deflection and be taken over by the yarn suction device, so t hat no significant fluctuations occur in the yarn tension during the doffing phase. Preferably, the suction device is stationary. In the case of a suction device that is constructed for movement substantially parallel to the package, it is possible to place the loose yarn end with the tie-off bead in any desired position within the winding range.

To ensure that when the package is replaced with the empty tube, the yarn is reliably removed by the suction device, the drive roll or the tube includes a circumferential groove. Before the tube is brought into circumferential contact with the drive roll, the yarn is guided by the yarn guide, the yarn guide groove, and the suction device. This prevents the yarn advancing between the surfaces of the new tube and the drive roll from being clamped and braked by the new tube, as long as the latter has not yet reached its predetermined rotational speed. The yarn can then be transferred, without slacking, from the full package to a new tube. The suction device receiving the yarn ensures in the doffing phase an undisturbed yarn path in the devices upstream of the takeup device. The yarn guide groove may be formed radially extending in the circumferential direction on the circumference of the drive roll or on the circumference of the tube, so that during the acceleration of the tube the yarn is reliably guided without being clamped.

In a particularly advantageous further development of the apparatus, the yarn guide groove of the drive roll is formed in the circumferential portion of the drive roll or tube, which is contacted by the full package. This permits minimizing the deflections and deviations of the yarn during the doffing phase and, thus, the fluctuations of the yarn tension.

When the yarn guide groove is provided in the tube, it advantageously extends in the region of the tube, which is covered by the wound yarn.

In a particularly preferred development of the invention, the yarn guide groove is made with a groove depth T, which is at least greater than the yarn diameter. In this instance, the yarn guide groove has a groove width B, which is substantially greater than the groove depth. This yarn guide groove that is made relatively shallow with a great width ensures that the yarn does not leave the guide groove due to its natural dynamics. When the unwound tube is in contact with the drive roll, it is made sure that the yarn advances freely through the guide groove. Both the small groove depth and large groove width further effect that the yarn guide groove on the circumference of the drive roll or on the circumference of the tube does not significantly affect the buildup of the package during the winding cycle.

In another advantageous further development of the invention, the yarn guide groove is designed and constructed such that the groove depth T is greater than the groove width B. This narrow yarn guide groove permits holding the yarn safely in the yarn guide groove. In addition, the package buildup remains unaffected during the entire winding cycle. In order that the yarn enters the narrow groove, the traversing yarn guide may guide the yarn across the groove slowly at a reduced traversing speed.

In another, advantageous further development of the invention, a plurality of narrow grooves are arranged close to one another. The yarn need not be exactly positioned and yet enters one of the narrow grooves safely. Since the package buildup is defined by a cross wind, its formation is not disturbed even in the presence of a plurality of yarn guide grooves arranged side by side.

In a particularly advantageous further development of the apparatus, the cutting device, the yarn guide, the yarn guide groove on the circumference of the drive roll, and the suction device are arranged in a transfer plane. This permits depositing the yarn at first as a tie-off wind on the full package and transferring it to the suction device without substantial deflection. Furthermore, a simple swing motion of a transfer device enables the yarn to enter the cutting device of the suction system. In this instance, a deflection is needed only in the transfer plane. The gripping arm of the transfer device engages the yarn in its advance between the previously raised package and the yarn guide. This development has furthermore the advantage that when the package is raised from the drive roll, the transfer device keeps the yarn safely guided in the yarn guide. Preferably, the transfer plane is formed as a normal plane of the package and contains the tie-off wind of the package. In this normal plane, the yarn guide groove is provided on the drive roll. However, it is also possible to design and construct the yarn guide groove obliquely to the axis of the drive roll. This imparts to the yarn a wobbling motion, which leads to an improved cohesion of the yarn layers, when the tie-off wind is wound.

In the previously described operations for doffing the package, catching the yarn, and winding initial layers thereof, there exists the possibility that an auxiliary device removes the yarn from a traversing yarn guide at the beginning of the package doff, and that subsequently the yarn guide of the auxiliary device receives the yarn. In this instance, the yarn guide is constructed preferably with a drive, which moves the yarn guide in the longitudinal direction parallel to the tube, and performs the movement of the yarn independently of direction at a variable speed. In this instance, the drive could be realized by a linear drive.

In a particularly advantageous further development of the invention, the function of the yarn guide of an auxiliary device is assumed and performed by a traversing yarn guide of a traversing device. To this end, the traversing yarn guide is capable of guiding the yarn outside and inside the winding range in the longitudinal direction parallel to the tube. This development has the advantage that no additional auxiliary device and its control are needed. All operations during the winding, package doff, and catching are controlled via a controller of the traversing device.

Once the yarn is caught and wound in first layers on the tube, the actual winding cycle starts, i.e. winding of the package. Once the package is fully wound, the yarn is taken over by the suction device for purposes of initiating the package doff. To this end, the traversing yarn guide that reciprocates the yarn, stops in a transfer plane. At first, a tie-off bead is wound on the full package. To this end, the full package has previously been raised from the drive roll. Subsequently, the transfer device guides the yarn into the suction system. Once the package is doffed, and the empty tube is clamped in the package holder between the clamping plates, the threading of the yarn will start. Before the new tube is placed onto the drive roll, the traversing yarn guide and the yarn guide groove in the drive roll guide the yarn between the tube and the drive roll. The tube is placed onto the drive roll and accelerated to a rotational speed necessary for threading the yarn. Once the rotational speed is reached, the drive of the traversing yarn guide is activated, and the traversing yarn guide leads the yarn to a catching position, in which the yarn advances obliquely over a catching plane of the catching device, for example, a front edge of the clamping plate.

The method of the present invention distinguishes itself by a fast and precise doffing of the package. In particular, the guidance of the yarn upstream and downstream of the catching device permits a very accurate positioning of the yarn, so that while the package is doffed, the yarn is safely guided without a substantial slack, and caught by the catching device.

For catching the yarn on the new tube, the yarn guide is moved with the yarn to a catching position which is outside the winding range, so that the yarn slides out of the guide groove and crosses a catching plane of the catching device. This allows a great freedom of variation for the catching device. In addition, it is possible to avoid unnecessary yarn loopings.

The use of the apparatus according to the invention in a false twist texturing machine is especially advantageous, since the false twist machine comprises a plurality of takeup devices, which perform a package doff after each wound package without a manual operation. A false twist texturing machine equipped with the apparatus of the present invention thus possesses the previously described advantages.

BRIEF DESCRIPTION OF THE DRAWINGS

In the following, both the apparatus and the method of the present invention are described in greater detail, with reference to the attached drawings, in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
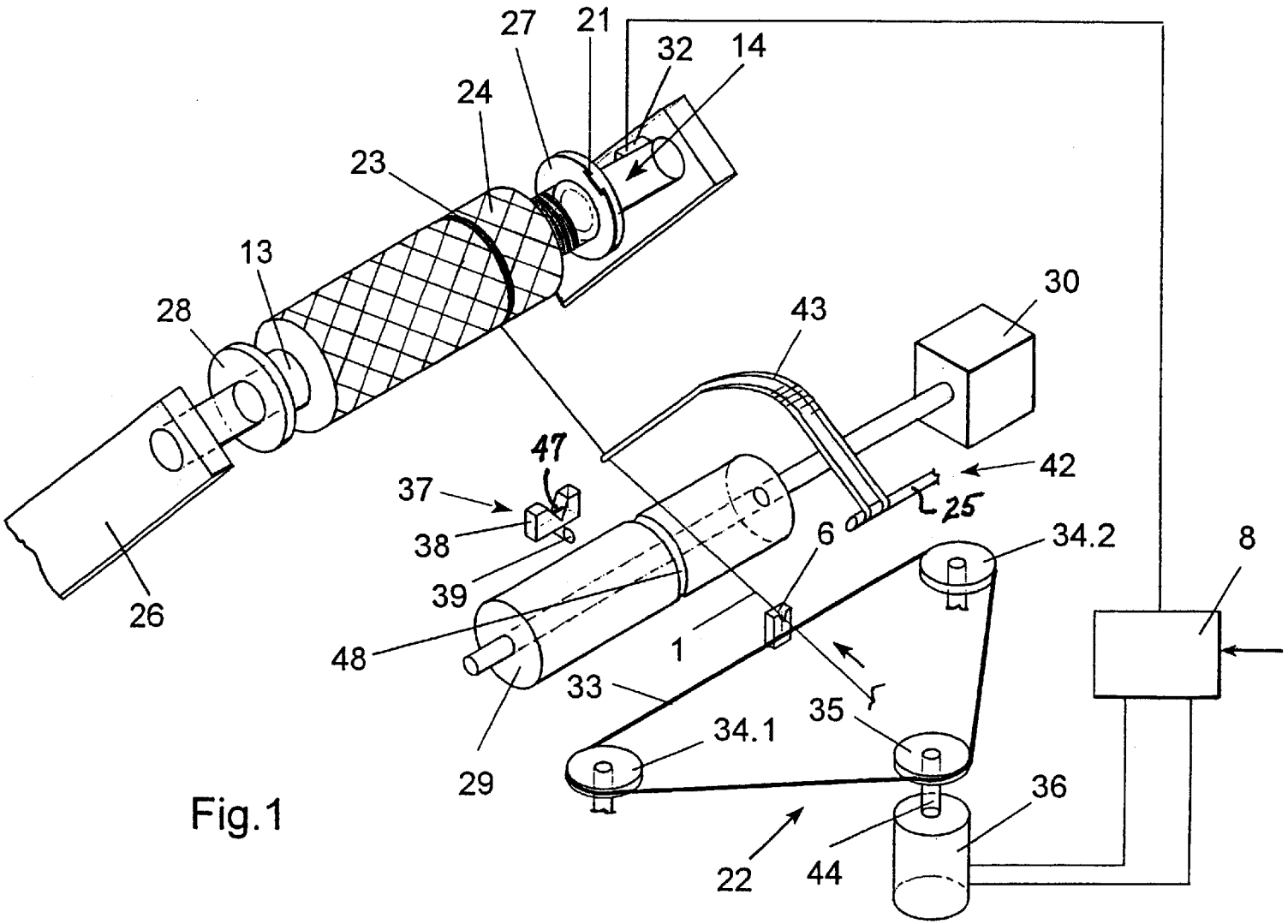
FIG. 1 is a schematic view of an embodiment of an apparatus according to the invention during a package doff.
Figure 2:
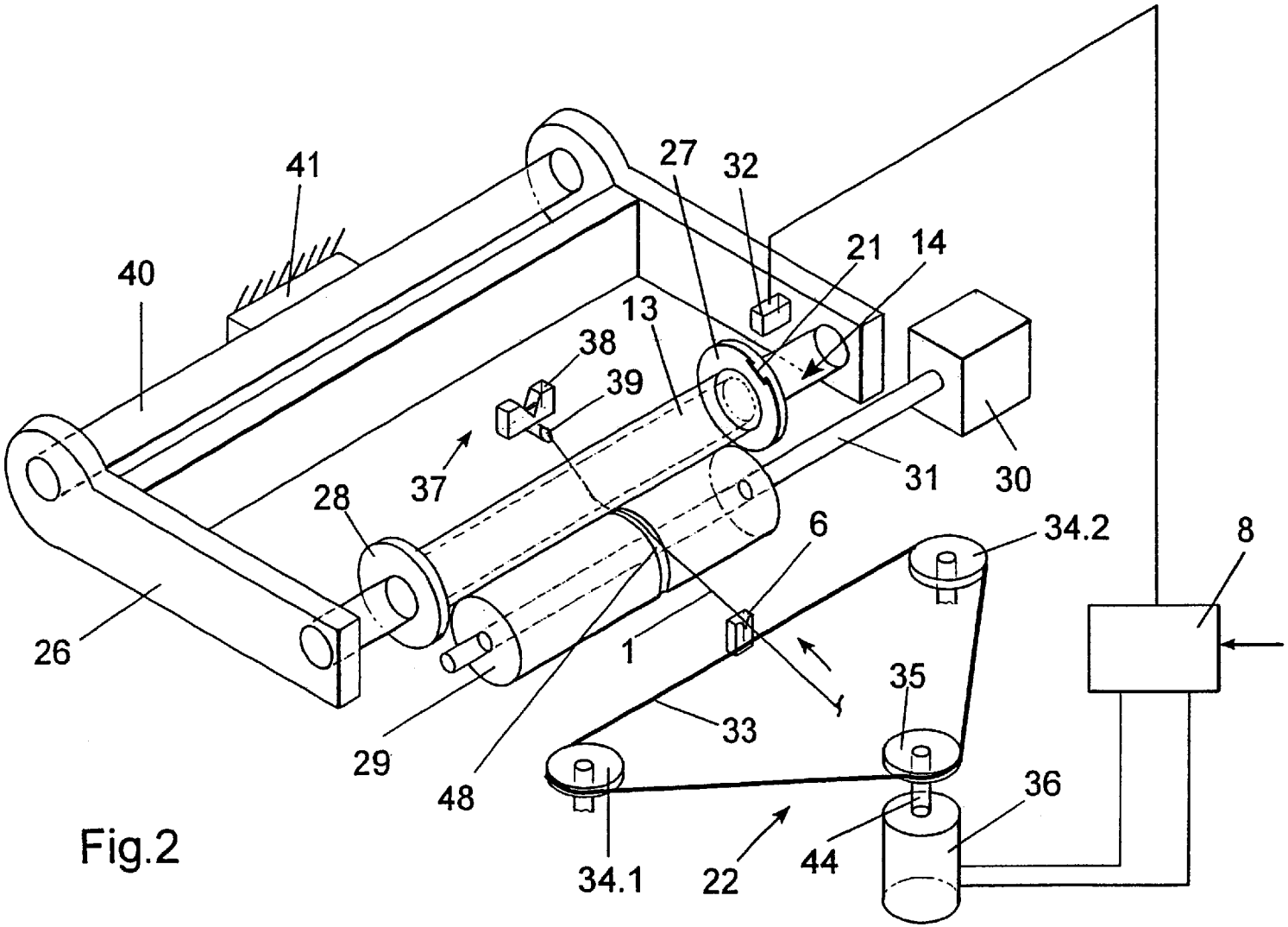
FIG. 2 is a schematic view of the apparatus of FIG. 1 during the catching of a yarn.

FIGS. 1 and 2 illustrate a first embodiment of an apparatus according to the invention within a takeup device, as may be used, for example, in a texturing machine. Therefore, the following description will apply to FIG. 1 and FIG. 2, unless otherwise specified.

The takeup device comprises a swinging package holder 26, which is supported on a pivot shaft 40. The pivot shaft 40 is mounted to a machine frame 41. At the free ends of the fork-shaped package holder 26, two opposite clamping plates 27 and 28 are mounted for rotation. Clamped between the clamping plates 27 and 28 is a tube 13 for receiving a package. To this end, the clamping plates 27 and 28 comprise each a conical centering extension that extends in part into the tube end. With that, the tube 13 is centered between the clamping plates 27 and 28. A drive roll 29 lies against the surface of tube 13. A yarn guide groove 48 radially extending in the circumferential direction is arranged on the circumference of the drive roll 29. The yarn guide groove 48 has a small depth, which makes it essentially possible to receive an advancing yarn, without clamping it between the surfaces of the drive roll 29 and the empty tube in contact therewith. The drive roll 29 is mounted on a drive shaft 31. At its one end, the drive shaft 31 connects to a drive roll motor 30. The motor 30 drives the drive roll 29 at a substantially constant speed. Via frictional engagement, the tube 13 is thus accelerated by means of the drive roll 29 to a winding speed, so that a yarn 1 is wound to a package on the tube 13. To this end, a traversing yarn guide 6 is arranged in the yarn path upstream of the drive roll 29. The traversing yarn guide connects to a traverse drive, which oscillatingly drives the traversing yarn guide 6 within the winding range.

In the present embodiment, the traversing yarn guide 6 guides the yarn 1 for purposes of doffing a package, catching the yarn, and winding initial layers thereof.

A yarn traversing device 22 is designed and constructed as a so-called belt-type traversing system. In this traversing system, the traversing yarn guide 6 is mounted to an endless belt 33. The belt 33 extends between two deflection pulleys 34.1 and 34.2 parallel to the tube 13. In the plane of the belt, a drive pulley 35 that is partially looped by the belt, is arranged parallel to the deflection pulleys 34.1 and 34.2. The drive pulley 35 is mounted on a drive shaft 44 of an electric motor 36. The electric motor oscillatingly drives the drive pulley 35, so that the traversing yarn guide 6 reciprocates in the region between the deflection pulleys 34.1 and 34.2. The electric motor is controllable by a controller 8.

On the side opposite to the traversing system toward the tube 13 or drive roll 29, a suction device 37 is arranged. The suction device 37 consists of a cutting device 38 and a suction inlet end 39. In the illustrated embodiment, the suction inlet end 39 is arranged between the cutting device 38 and the tube 13. The suction inlet end 39 possesses a slot-shaped suction orifice 46, which is arranged in alignment with a cutting blade 47 of the cutting device 38.

FIGS. 1 and 2 show the takeup device in different operating situations. FIG. 1 shows the takeup device at the end of a winding cycle. After the package 24 is fully wound, the traversing yarn guide 6 is positioned in a transfer plane. The traversing yarn guide 6 remains in this transfer plane. A tie-off wind 23 is now being produced on the package 24. At the same time, the package holder 26 swings with the package 24 out of the operating position. This activates a transfer device 42 arranged laterally of the winding range. The transfer device 42 has a gripping arm 43, which extends with one free end through the transfer plane. The gripping arm 43 is mounted for rotation on a pivot shaft 25, and is moved by a drive (not shown) parallel to the transfer plane. The gripping arm 43 is dimensioned such that its free end engages the yarn between a yarn guide 6 and the package 24, and guides the yarn 1 in the transfer plane to the suction device 37. The suction device 37 lies within a path of motion that is described by the free end of gripping arm 43. With that, it is realized that the yarn 1 enters the cutting device 38 and is cut by blade 47. Shortly before or at the same time, the yarn 1 enters the slot-shaped orifice of suction inlet end 39. The end of the advancing yarn is thus removed by suction immediately after cutting. On the package, the loose yarn end is deposited in the region of the tie-off wind. At the same time, the yarn enters the yarn guide groove 48 of drive roll 29. This permits replacing the full package 24 with an empty tube. Once the package 24 has been replaced with a tube, the threadup sequence will start. After cutting the yarn 1, the transfer device 42 returns to its initial position.

FIG. 2 illustrates the beginning of the threadup operation. The continuously advancing yarn is guided by the suction device 37, yarn guide groove 48, and traversing yarn guide 6. For the sake of clarity, the illustration of the transfer device was omitted in FIG. 2. To this end, the yarn end is taken into a suction orifice of the suction inlet end 39. As soon as the yarn 1 is guided by the traversing yarn guide 6 and the yarn guide groove 48 within the contact range between the tube 13 and the drive roll 29, the tube 13 is brought into circumferential contact with the drive roll 29. The tube 13 is accelerated by the drive roll 29 in circumferential contact therewith to a winding speed that is predetermined by the drive roll. Once the tube 13 has reached the winding speed, the controller 8 activates the electric motor 36 such that it moves the traversing yarn guide to a catching position. The yarn 1 slides out of yarn guide groove 48 and now crosses the plane of a catching device 14, so that it engages a catching groove 21. The yarn is caught with catching groove 21 and cut with a blade integrated in the catching device or clamping plate 27. Such a clamping plate is known, for example, from EP 0 403 949, which is herewith incorporated by reference.

After the catching, the traversing yarn guide 6 is moved from its catching position to the winding range. In so doing, the yarn 1 is wound on the tube 13 to a yarn reserve wind outside of the winding range. In this instance, the yarn reserve wind could be formed by a traversing yarn guide 6 that remains in one position. If so, the yarn reserve wind will comprise a number of parallel winds. However, it is also possible to move the traversing yarn guide 6 at a speed defined by the electric motor 36 to the winding range, so that side-by-side winds are produced in the yarn reserve wind. As soon as the yarn guide reaches the winding range, the winding cycle will start. The traversing yarn guide 6 is then driven by the traversing device 22 for oscillation within the winding range. The rotated position of the package holder 26 follows the increasing diameter of package 24. To this end, the package holder 26 comprises biasing means, which generate on the one hand, between the package 24 and the drive roll 29, a contact pressure which is necessary to drive the package, and enable on the other hand a swing motion of the package holder 26 for the package doff.

The embodiment of the invention as shown in FIGS. 1 and 2 is not limited to guiding the yarn by the traversing yarn guide during the doffing procedure. When a different kind of traversing device is used, which is driven, for example, by a cross-spiraled shaft, it is possible to use a separately driven auxiliary yarn guide. To this end, the yarn guide is arranged for movement between the traversing yarn guide and the tube. A drive permits reciprocating the yarn guide in a plane parallel to the tube 13 such that the yarn can be transferred from the traversing yarn guide at the end of the winding cycle. Subsequently, the yarn guide is moved to the transfer plane, so that the package doff starts as previously described. The drive of the yarn guide is likewise controllable by the controller shown in FIGS. 1 and 2.

The further sequence is identical with the foregoing description, with the traversing yarn guide being replaced with the yarn guide. After catching the yarn and winding initial layers thereof, the yarn is returned to the traversing yarn guide.

Figure 3:
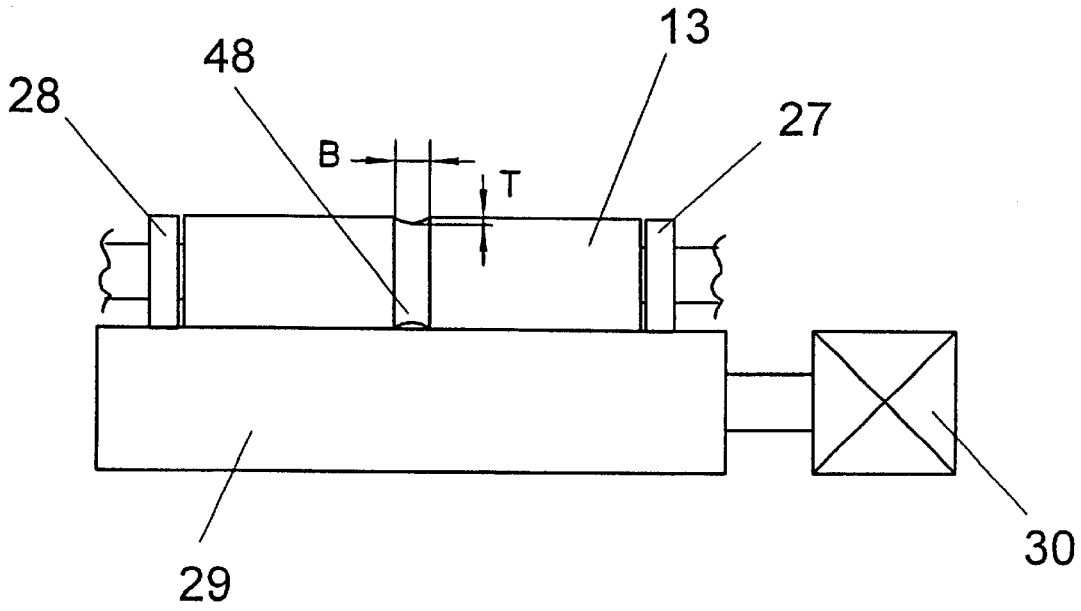
FIGS. 3 and 4 are schematic views of further embodiments of the yarn guide groove.
Figure 4:
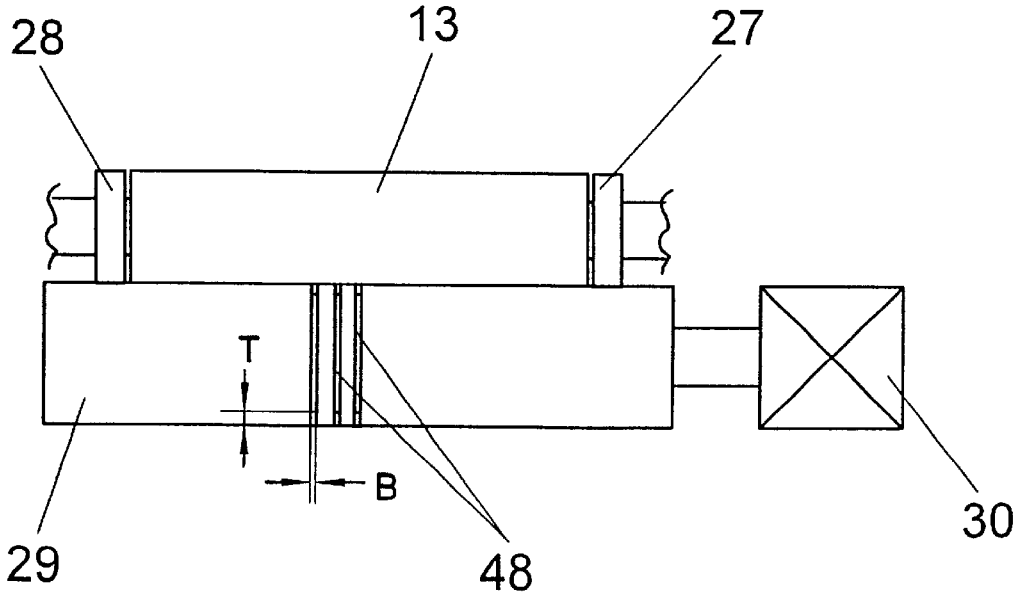

FIGS. 3 and 4 schematically illustrate further embodiments of the yarn guide groove. Shown in FIGS. 3 and 4 are a drive roll 29 with a tube 13 in contact therewith. The tube 13 is clamped between the clamping plates 27 and 28. The clamping plates 27 and 28 are connected to a swinging package holder (not shown). The drive roll 29 in contact with the circumference of tube 13 is driven by the drive roll motor 30 at a predetermined winding speed. As a result, the tube 13 in contact with the circumference of drive roll 29 is initially accelerated, until the desired rotational speed is reached.

In FIG. 3, the tube 13 comprises in its center region on the circumference a yarn guide groove 48. The yarn guide groove 48 has a depth T and a width B. The groove depth T is somewhat greater than the yarn diameter, so that a yarn advancing in the yarn guide groove 48 between the tube 13 and drive roll 29 is guided without being clamped. In proportion with its depth T, the yarn guide groove 48 has a substantially greater width B. Preferably, the sides of the groove are made gentle, so that a very wide yarn guide groove results with a small depth. This development of the yarn guide groove, which could likewise be arranged on the circumference of the drive roll, affects the package buildup very little during the winding of the yarn.

In the embodiment shown in FIG. 4, the drive roll 29 contains a plurality of yarn guide grooves 48 that extend parallel side by side. In this embodiment, the yarn guide grooves have a small width B and a relatively great depth T. This results in a very narrow yarn guide groove, wherein the groove width B is smaller than the groove depth T. Due to the very narrow yarn guide groove, the package buildup remains unaffected. The arrangement of a plurality of yarn guides allows to accomplish that despite the very small groove width, the yarn is able to enter one of the grooves quickly and reliably.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A yarn winding apparatus for winding a continuously advancing yarn into a package and having provision for guiding and cutting the continuously advancing yarn during doffing of a full package, and comprising a package holder for rotatably mounting a winding tube, and a drive roll, with the winding tube and drive roll being mounted for relative movement between an operative position wherein the drive roll is in contact with the winding tube or the package being formed thereon, and a doffing position wherein the drive roll is separated from the winding tube or package, a yarn guide mounted for movement in an axial direction on an upstream side of the winding tube, a yarn cutting and suction device mounted on a downstream side of the winding tube, a transfer device for guiding the advancing yarn from the yarn guide to the suction device when the winding tube and the drive roll are in the doffing position and so that the yarn is cut and suctioned off, and at least one circumferential yarn guide groove formed in the drive roll or the winding tube so that the yarn is guided into the groove after its takeover by the yarn cutting and suction device and the yarn is protected when a new winding tube is moved to the operative position and accelerated by the drive roll.

2. The apparatus as defined in claim 1 further comprising a yarn traversing mechanism for traversing the advancing yarn along the winding tube to define a winding range and form a wound package on the tube.

3. The apparatus as defined in claim 2 wherein said yarn guide groove is positioned to lie within the winding range.

4. The apparatus as defined in claim 3 wherein the yarn guide groove has a depth (T) which is greater than the yarn diameter and forms with a groove width (B) a ratio of $B/T>1$.

5. The apparatus as defined in claim 3 wherein the yarn guide groove has a depth (T) which is greater than the yarn diameter and forms with a groove width (B) a ratio of $B/T<1$.

6. The apparatus as defined in claim 3 wherein a plurality of yarn guide grooves are formed on the circumference of said drive roll.

7. The apparatus as defined in claim 2 wherein the yarn guide, the yarn cutting and suction device, and the yarn guide groove lie in a common transfer plane which is within the winding range when the transfer device moves the advancing yarn to the yarn cutting and suction device.

8. The apparatus as defined in claim 7 wherein the transfer device comprises a gripping arm which is mounted for movement parallel to the transfer plane and which includes a free end which is moveable into the yarn path between the yarn guide and the package on the winding tube when in the doffing position and to the yarn cutting and suction device, and such that the yarn is guided into the yarn guide groove.

9. The apparatus as defined in claim 7 further comprising a yarn catching device located adjacent one of the ends of the winding tube, and wherein the yarn guide is moveable to a location outside of the winding range so that the advancing yarn engages and is caught by the catching device.

10. The apparatus as defined in claim 2 wherein said yarn traversing mechanism includes said yarn guide and a drive for reciprocating the yarn guide axially along the winding tube.

11. A yarn false twist texturing machine comprising means for continuously advancing a yarn along a path of travel while imparting false twist texturing to the yarn, a yarn winding apparatus for winding the textured yarn to a package on a winding tube that is rotatably driven by contact with a drive roll, and then separating the package and the drive roll during a package doff, means for cutting and suctioning off the advancing yarn during the package doff, a circumferential guide groove formed on the drive roll, and a yarn guide which is moveable to a position wherein the yarn is guided in the groove when a new winding tube is brought into contact with the drive roll at the conclusion of a package doff.

12. The yarn false twist texturing machine as defined in claim 11 wherein the guide groove in the drive roll is formed in the region of the drive roll which is contacted by the package being wound.

13. The yarn false twist texturing machine as defined in claim 12 wherein the guide groove has a groove depth (T) which is greater than the yarn diameter and which forms with a groove width (B) a ratio of $B/T>1$.

14. The yarn false twist texturing machine as defined in claim 12 wherein the guide groove has a groove depth (T) which is greater than the yarn diameter and which forms with a groove width (B) a ratio of $B/T<1$.

15. A method of doffing a yarn winding machine which includes a package holder for rotatably supporting a winding tube and which is driven by contact with a drive roll, and a traversing mechanism for traversing an advancing yarn along the winding tube to define a winding range and form a wound package on the tube, and comprising, when the package becomes full, the steps of guiding the advancing yarn with a moveable yarn guide to a location within the winding range to form a tie off winding on the full package, removing the full package from contact with the drive roll, engaging the yarn between the yarn guide and the full package with a transfer device and moving the transfer device so as to move the yarn into contact with a device for cutting and suctioning off the advancing yarn, removing the full package from the package holder and replacing the same with a new winding tube, and moving the new winding tube into contact with the drive roll so as to accelerate the new winding tube and while guiding the advancing yarn in a circumferential guide groove formed in either said drive roll or the new winding tube so that the advancing yarn is protected while moving through a contact zone between the drive roll and the new winding tube during the acceleration of the new winding tube.

16. The method as defined in claim 15 comprising the further subsequent step of moving the yarn guide to a location outside of the winding range so that the advancing yarn slides out of the circumferential groove and engages a yarn catching device which is located adjacent one end of the new winding tube.

17. The method as defined in claim 16 wherein the moveable yarn guide is located in the yarn path upstream of the winding tube and the cutting and suctioning device is located downstream thereof during the winding process.

* * * * *